US008390418B2

(12) United States Patent
Stahmann et al.

(10) Patent No.: US 8,390,418 B2
(45) Date of Patent: Mar. 5, 2013

(54) APPARATUS AND METHOD FOR REDUCING INDUCTOR SATURATION IN MAGNETIC FIELDS

(75) Inventors: Jeffrey E. Stahmann, Ramsey, MN (US); Scott R. Stubbs, Maple Grove, MN (US); Arthur Foster, Centerville, MN (US)

(73) Assignee: Cardiac Pacemakers, Inc., St. Paul, MN (US)

( * ) Notice: Subject to any disclaimer, the term of this patent is extended or adjusted under 35 U.S.C. 154(b) by 0 days.

(21) Appl. No.: 12/977,172

(22) Filed: Dec. 23, 2010

(65) Prior Publication Data

US 2011/0163834 A1 Jul. 7, 2011

Related U.S. Application Data

(60) Provisional application No. 61/292,302, filed on Jan. 5, 2010.

(51) Int. Cl.
*H01F 27/24* (2006.01)

(52) U.S. Cl. ..... 336/212

(58) Field of Classification Search ..... 336/83, 336/212, 233–234, 220–223; 607/9, 36–61
See application file for complete search history.

(56) References Cited

U.S. PATENT DOCUMENTS

| | | | | |
|---|---|---|---|---|
| 3,781,740 | A * | 12/1973 | Kirmis et al. | 336/96 |
| 4,009,460 | A * | 2/1977 | Fukui et al. | 336/110 |
| 5,525,951 | A * | 6/1996 | Sunano et al. | 336/160 |
| 6,885,272 | B1 | 4/2005 | Piaskowski et al. | |
| 6,937,906 | B2 | 8/2005 | Terry et al. | |
| 7,123,122 | B2 * | 10/2006 | Pohl et al. | 336/192 |
| 7,283,378 | B2 | 10/2007 | Clemmons | |
| 7,388,378 | B2 | 6/2008 | Gray et al. | |
| 7,423,508 | B2 | 9/2008 | Gardner et al. | |
| 7,443,274 | B2 * | 10/2008 | Lee et al. | 336/84 M |
| 2005/0197677 | A1 | 9/2005 | Stevenson | |
| 2006/0125586 | A1 * | 6/2006 | Lee et al. | 336/83 |
| 2009/0204182 | A1 | 8/2009 | Ameri | |

FOREIGN PATENT DOCUMENTS

EP 1471973 B1 10/2009

* cited by examiner

*Primary Examiner* — Tuyen Nguyen
(74) *Attorney, Agent, or Firm* — Schwegman Lundberg & Woessner, P.A.

(57) ABSTRACT

This document discusses, among other things, an inductive component that can include a core having two portions: (1) a first portion composed of a first material having a first magnetic saturation level; and (2) a second portion composed of a second material selected to provide inductance for the inductive component when an external magnetic field is greater than the first magnetic saturation level. In an example, the first portion can be composed of a material having a relatively low magnetic saturation level (e.g., a ferrite), and the second portion can be composed of a material having a relatively high magnetic saturation level (e.g., a high permeability iron alloy).

20 Claims, 3 Drawing Sheets

APPARATUS AND METHOD FOR REDUCING INDUCTOR SATURATION IN MAGNETIC FIELDS

CROSS-REFERENCE TO RELATED APPLICATIONS

This application claims the benefit of U.S. Provisional Application No. 61/292,302, filed on Jan. 5, 2010, under 35 U.S.C. §119(e), which is incorporated herein by reference in its entirety.

BACKGROUND

Implantable devices can be affected by strong magnetic fields, such as the magnetic fields produced by a magnetic resonance imaging (MRI) scanner. The magnetic field produced by a typical MRI scanner has a strength of 1.5 Tesla or higher. Magnetic fields of this magnitude can saturate the ferrite cores of inductive components within the implantable device. When the core of an inductive component saturates, the core may fail to provide the inductance needed for operation of the inductive component. This can impact operation of the circuit associated with the inductive component. In an example, ferrites have a general chemical formula of $MOFe_2O_3$, where MO is a combination of one or more divalent metal oxides (e.g., zinc, nickel, manganese, copper). In an illustrative example, a particular ferrite material saturates when exposed to a magnetic field strength above 0.35 Tesla.

OVERVIEW

Inductive components can be used in implantable medical devices (IMD), such as in a circuit to create a voltage, such as for supplying power to internal circuitry or providing a stored energy that can be delivered as therapy. When the core of an inductor is exposed to a magnetic field, such as from an MRI, the magnetic field of the inductor can saturate. This can inhibit or prevent the circuit from creating a desired voltage, current, or can have other effects on circuit operation. Thus, saturation of inductive components can lead to undesirable device behavior of an implantable medical device or other device.

One example of undesirable behavior is the loss of voltage, or increased time required to charge a capacitor to a desired defibrillation therapy voltage for a patient implanted with an implantable cardioverter-defibrillator (ICD). Under such circumstances, the ICD typically must wait until after the MRI scan has completed before being ready to deliver defibrillation therapy. In another example, the loss of voltage can result in loss of an ability to deliver pacing therapy.

The present inventors have recognized, among other things, that there are materials that can operate as a core for an inductive component (e.g., in a defibrillation therapy voltage charging circuit) without saturation at higher magnetic fields (e.g., high permeability iron alloys). The present inventors have also recognized that such cores in IMDs cannot consist exclusively of these materials, because other magnetic properties of these materials are not appropriate to their application within IMDs. For example, the permeability may be too low or the bulk conductivity may be too high.

This document discusses, among other things, an inductive component that can be configured to operate effectively in both weak and strong magnetic field environments. In an example, the inductive component can include a core having two portions: (1) a first portion configured for providing inductance in a weak magnetic field; and (2) a second portion configured for providing inductance in a strong magnetic field. In an example, the first portion can be composed of a material having a low magnetic saturation level (e.g., a ferrite), and the second portion can be composed of a material having a high magnetic saturation level (e.g., a high permeability iron alloy).

Example 1 includes an implantable medical device comprising a core for an inductive component. The core comprises a first portion composed of a first material selected to provide inductance for the inductive component, the first material having a first magnetic saturation level, and a second portion composed of a second material selected to provide inductance for the inductive component when an external magnetic field is greater than the first magnetic saturation level.

In example 2, the first and second material of example 1 are optionally configured to provide an inductance via at least one of ferromagnetism and ferromagnetism.

In example 3, the first material of one or any combination of examples 1-2 optionally includes a maximum inductance, and the second material of one or any combination of examples 1-2 is optionally configured to provide inductance that is at least 10% of the maximum inductance of the first material when the first material substantially saturates.

In example 4, the first magnetic saturation level of one or any combination of examples 1-3 is optionally less than 0.6 Tesla, and the second material of one or any combination of examples 1-3 has a second magnetic saturation level of greater than 1.5 Tesla.

In example 5, the first material of one or any combination of examples 1-4 optionally includes a ferrite, and the second material of one or any combination of examples 1-4 optionally includes at least one of: a ferromagnetic metallic alloy and a magnetic nanoparticle based material.

In example 6, the second material of one or any combination of examples 1-5 optionally has a volume that is in the range of 5%-30% relative to a volume of the first material.

In example 7, the second material of one or any combination of examples 1-6 optionally includes a resistivity greater than 10 μΩ·cm.

In example 8 the first material one or any combination of examples 1-7 optionally forms a first continuous magnetic loop, and the second material one or any combination of examples 1-7 optionally forms a second continuous magnetic loop.

In example 9, the second material one or any combination of examples 1-8 optionally comprises a plurality of sheets interspersed with the first material.

In example 10 the first material one or any combination of examples 1-9 optionally comprises a plurality of sheets, and an insulator is positioned between the adjacent pairs of the sheets.

In example 11, the implantable medical device of one or any combination of examples 1-10 optionally includes a flyback power converter including the inductive component.

In example 12, the second material of one or any combination of examples 1-11 optionally provides inductance for the inductive component when an external magnetic field is below the first magnetic saturation level.

Example 13 includes an apparatus comprising an inductive component. The inductive component comprises a first electrically conductive wire forming a first at least one loop, a first material positioned at least partially within the first at least one loop so as to provide an inductance for the first electrically conductive wire when a current is propagated through the conductive wire, wherein the first material having a first magnetic saturation level, and a second material positioned at least partially within the first at least one loop so as to provide an inductance for the first electrically conductive wire when a current is propagated through the conductive wire, wherein the second material is selected to provide an inductance when an external magnetic field is greater than the first magnetic saturation level.

In example 14, the second material of example 13 optionally has a higher magnetic saturation level than the first material.

In example 15 the first and second material of one or any combination of examples 13-14 are optionally configured to provide an inductance via at least one of ferromagnetism or ferromagnetism.

In example 16 the first material of one or any combination of examples 13-15 optionally has a first magnetic saturation level of less than 0.6 Tesla, and the second material of one or any combination of examples 13-15 optionally has a second magnetic saturation level of greater than 1.5 Tesla.

In example 17, the first material of one or any combination of examples 13-16 optionally includes a ferrite, and the second material of one or any combination of examples 13-16 optionally includes at least one of: a ferromagnetic metallic alloy and a magnetic nanoparticle based material.

Example 18 includes a method comprising generating an inductance, with a first material, from a current propagating through at least one loop of conductive wire, when the first material is exposed to an external magnetic field below a first magnetic saturation level of the first material, and generating an inductance, with a second material, from a current propagating through the at least one loop of conductive wire, when the second material is exposed to an external magnetic field above the first magnetic saturation level.

In example 19, the first magnetic saturation level of example 18 is optionally 0.6 Tesla.

In example 20 the first material of one or any combination of examples 18-19 optionally provides a first inductance when the external magnetic field is below the first magnetic saturation level, and the second material of one or any combination of examples 18-19 optionally provides a second inductance that is at least 10 percent of the first inductance when the external magnetic field is above the first magnetic saturation level.

These examples can be combined in any permutation or combination. This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventors have recognized that, among other things, an inductive core having two portions, each portion having a different magnetic saturation level, can be used to provide inductance for a circuit that can be operated in both a weak and a strong magnetic field. In an example, a first portion of the inductive core can be composed of a material having a first magnetic saturation level (e.g., a ferrite having a magnetic saturation level of 0.35 Tesla), and a second portion of the inductive core can be composed of a material having a magnetic saturation level higher than the first portion (e.g., a high permeability iron alloy having a magnetic saturation level of 1.6-2.0 Tesla).

Figure 1:
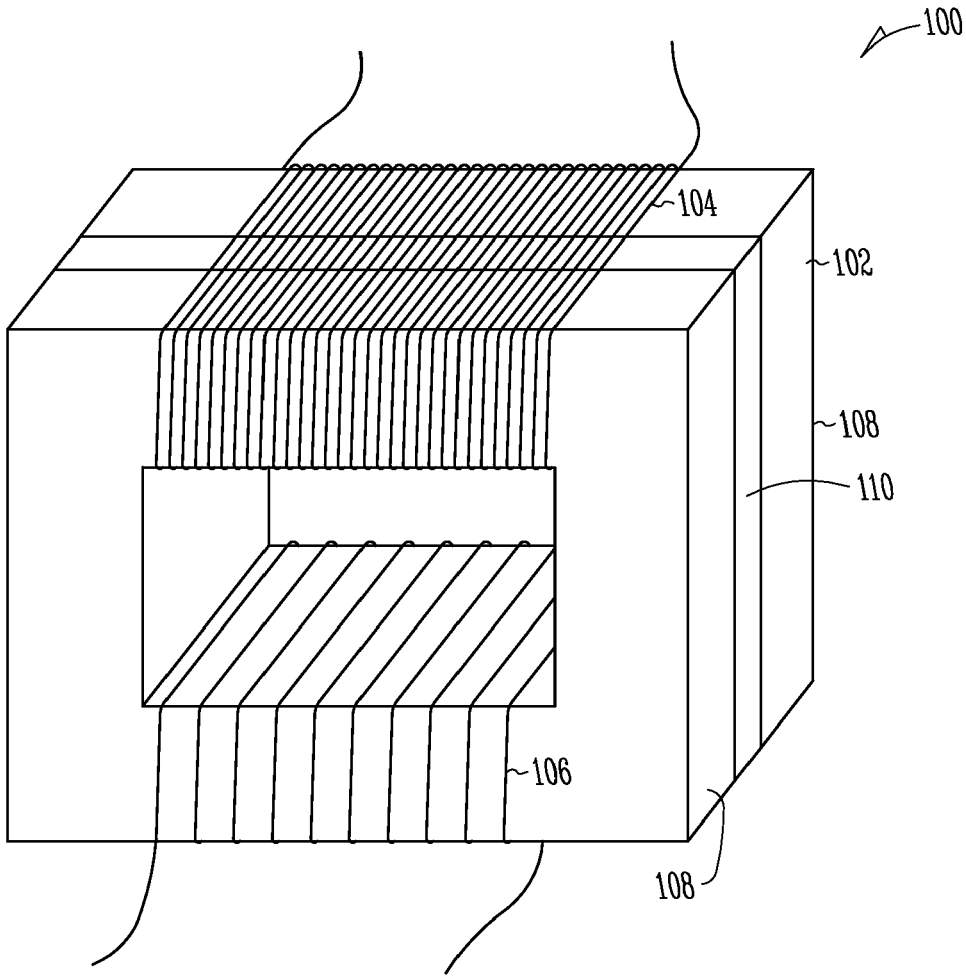
FIG. 1 illustrates generally an example of an inductive component that can include a toroid core that can have a first and a second portion such as for providing inductance in both a weak and a strong magnetic field.

FIG. 1 illustrates generally an example of an inductive component 100 that can include a core 102, and a first winding 104 and a second winding 106. The first and second windings 104, 106 can include a plurality of loops, such as of electrically conductive wire. The core 102 can be positioned within the loops, such as with the first and second winding 104, 106 extending around the core 102. The inductive component 100 of FIG. 1 can form a transformer, however, in other examples, (e.g., FIG. 2) the inductive component can include an inductor, choke, or other inductive device.

The core 102 can include a first portion 108 and a second portion 110. In an example, the first portion 108 of the core 102 can be composed of a first material, and the second portion 110 can be composed of a second material. In an example, the first and second materials can be one of ferromagnetic or ferrimagnetic materials such that the first and second materials can maintain a magnetic field for at least a portion of time after applying an external magnetic field thereto.

In an example, the first and second materials can provide an inductance for a current propagating through the first or second winding 104, 106. As referred to herein a material is configured to "provide an inductance" when the material has a relative magnetic permeability (also referred to herein as "relative permeability") of greater than that of a paramagnetic material. A paramagnetic material, for example, has a relative permeability of slightly greater than one (e.g., 1.000265).

In an example, the first and second materials each have a magnetic saturation level (also referred to herein as "saturation level" and referred to in the art as "$B_{sat}$") that defines the strength of an external magnetic field at which the material saturates and can no longer provide an inductance. In an example, when an external magnetic field is below the magnetic saturation level of a material, the material has a relative permeability above that of a paramagnetic material and the material is capable of providing an inductance. When the external magnetic field is above the magnetic saturation level, however, the material saturates and the relative permeability of the material drops to approximately equal to that of a paramagnetic material. Accordingly, when the external magnetic field is above the magnetic saturation level the material cannot provide an inductance.

In an example, the first material has a first saturation level. In an example, the first material can be selected based on the first saturation level and a normal external magnetic field strength expected for the environment of the first material. In certain examples, the first material can be selected such that the first material provides an inductance when the external magnetic field strength is near or below the normal external magnetic field strength. In an example, the first saturation level of the first material provides a buffer level above the normal magnetic field strength. In an example, the first saturation level can be 0.1 Tesla above the normal magnetic field strength. Accordingly, the first material does not provide an inductance when an external magnetic field strength is more than the buffer level above the normal external magnetic field. Generally, having a lower first saturation level provides advantages not available in material with a higher magnetic saturation level (e.g. lower bulk resistivity. In an example, the first material has a magnetic saturation level of less than 0.6 Tesla.

In an example, the second material can be selected to provide an inductance for the first and second windings 104, 106 when the external magnetic field strength is greater than the first saturation level. When the external magnetic field strength is above the first saturation level, the first material saturates and the first material cannot provide an inductance for the first and second windings 104, 106. To address the saturation of the first material, the second material is selected to provide an inductance when the first material saturates. Accordingly, the saturation level of the second material is greater than the first saturation level of the first material. In an example, the saturation level of the second material is greater than 1.5 Tesla. In an example, the second material has a resistivity of greater than 10 μΩ·cm. In an example, the second material can also provide an inductance when the external magnetic field is below the first saturation level, such that both the first and the second material provide inductance when an external magnetic field strength is below the first saturation level.

In an example, the second material can be selected such that, when the external magnetic field strength is above the first saturation level, the second material can provide at least 10% of the normal inductance of the first material. In an example, the normal inductance of a material is the inductance of the material in earth's magnetic field. In an example, a quantity of the second material is selected to provide the at least 10% of the normal inductance. In an example, the shape of the first material and the second material can also be selected in order to achieve the desired inductance and magnetic saturation levels. For example, the second material can be selected to have a quantity and shape suitable to provide at least 10% of the inductance of the first material when an external magnetic field strength is above the first saturation level. In an example, the volume of the second material can be in the range of 5%-30% of the volume of the first material. The larger the quantity of the second material (e.g., the volume of the second portion 110), the larger the resulting torque generated by the inductive component 100 when an external magnetic field is applied (e.g., by a MR scanner). Accordingly, in an example, the quantity of the second material can be kept small in order to reduce the resulting torque produced by the inductive component 100.

In an example, the first material is a ferrite and the second material includes at least one of a ferromagnetic metallic alloy and a magnetic nanoparticle based material. Examples of a ferromagnetic metallic alloy include cobalt-iron materials such as Hyperco having a saturation level of 2.4 Tesla and Supermendur having a saturation level of 2.3 Tesla. In an example, the first material has a magnetic saturation level of 0.35 Tesla and the second material has a magnetic saturation level of 1.5 Tesla. In another example, the first material has a magnetic saturation level of 0.5 Tesla and the second material has a magnetic saturation level of 2.4 Tesla.

In an example, the second material is selected to provide an inductance when the first material substantially saturates. As an external magnetic field strength approaches the saturation level of a material, the inductance provided by a material asymptotically decreases. In an example, a material is substantially saturated when the permeability of the material drops below 10% of the maximum permeability for the material. Accordingly, in an example, when the external magnetic field reaches a strength such that the permeability of the first material is less than 10% of the maximum permeability, the second material can provide inductance for the inductive component 100.

Although in the example shown in FIG. 1, only a first portion 108 and a second portion 110 are shown, in other examples, more than two portions can be included in the core 102. In certain examples, one or more of portions 108, 110 of the core 102 can include one or more gaps, such as to reduce core heating or eddy currents. The gaps can include air gaps or other paramagnetic or diamagnetic materials between portions of the first and second material.

The core 102 forms a continuous loop (e.g., a toroid) having first and second winding 104, 106 around the loop forming a transformer. In the core 102, the first and second portions 104, 106 are adjacent and distinct portions. In an example, the continuous loop formed by both the first and second portions 104, 106 forms a continuous magnetic circuit.

Figure 2:
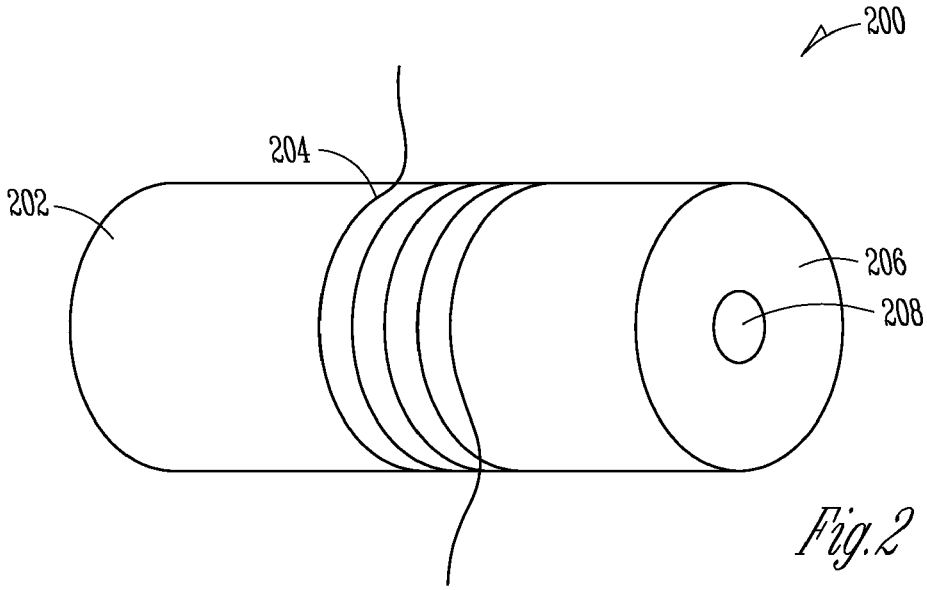
FIG. 2 illustrates generally an example of an inductive component that can include a solenoid core that can have a first and a second portion such as for providing inductance in both a weak and a strong magnetic field.

FIG. 2 illustrates generally another example of an inductive component 200 including a core 202 and a first winding 204. In this example, the core 202 can include an open magnetic inductor (e.g., a solenoid). In an example, the core 202, similar to core 102, can include a first portion 206 and a second portion 208. In an example, the first portion 106 is composed of a first material and the second portion is composed of a second material. In an example, the second material is selected to provide an inductance for the inductive component when an external magnetic field substantially saturates the first material. The first and second materials within the core 202 can be correspondingly similar to the first and second materials described above with respect to FIG. 1.

FIGS. 3A-3D illustrate generally examples of cross-sections of cores 300A, 300B, 300C, and 300D for an inductive component. In an example, the cross-sections of cores 300A, 300B, 300C, and 300D illustrated in FIGS. 3A-3D can be used in either the inductive component 100 or the inductive component 200.

Core 300A includes a first portion 302A and a second portion 304A. The first portion 302A is composed of the first material having a first saturation level and the second portion 304A is composed of the second material having a second saturation level, the second saturation level is higher than the first saturation level. Accordingly, the second material is capable of providing inductance when the first material is saturated by an external magnetic field. In an example, the second portion 304A is approximately 5% of the volume of the first portion 302A.

Figure 3B:
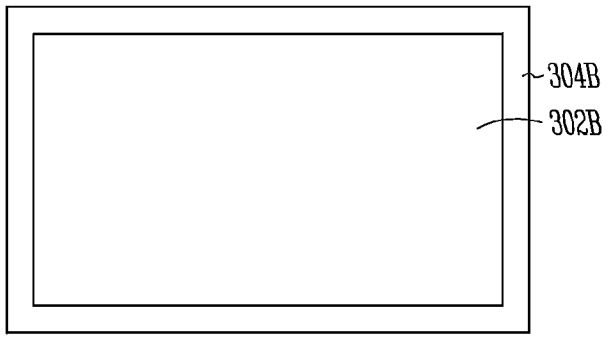
FIGS. 3A-3D illustrate generally examples of cross-sections of cores such as for the inductive component of FIG. 1 or FIG. 2.
Figure 3D:
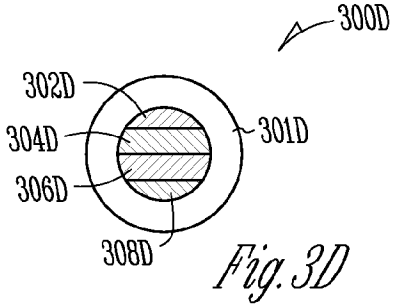
Figure 3A:
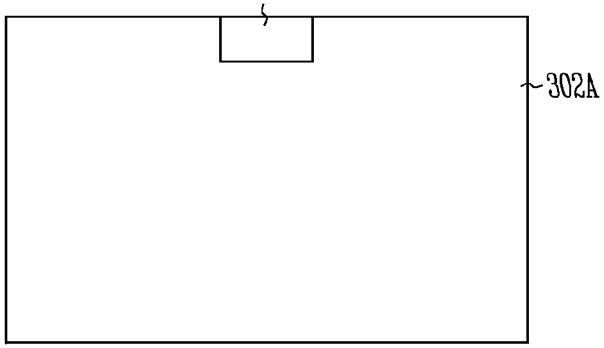

In an example, the cross-section of the core 300A shown in FIG. 3A can be substantially similar throughout the core 300A such that both the first portion 302A and the second portion 304A extend all around the continuous loop (in the case of a toroid core) or from one end to the other (in the case of a solenoid). In another example, the cross-section of the core 300A need not be substantially similar through the core 300A such that the second portion 304A extends only partially throughout the core 300A. As shown in FIG. 3A, the second portion 304A can include a strip on an outer wall of the first portion 302A. In another example, the second portion 304A can include a strip internal to (e.g., surrounded by) the first portion 302A.

FIG. 3B illustrates another cross-section of a core 300B. The core 300B also includes a first portion 302B and a second portion 304B. The first portion 302B is composed of a first material and the second portion 304B is composed of a second material. In an example, the first material has a lower magnetic saturation level than the second material. Accordingly, the second material is capable of providing inductance when the first material is saturated by an external magnetic field. In an example, the second portion 304B forms an outer layer around the first portion 302B. The second portion 304B is approximately 10% of the volume of the first portion 302B.

In an example, the cross-section of the core 300B shown in FIG. 3B is substantially similar throughout the core 300B such that both the first portion 302B and the second portion 304B extend all around the continuous loop (in the case of a toroid core) or from one end to the other (in the case of a solenoid). In another example, the cross-section of the core 300B is not substantially similar through the core 300B such that the second portion 304B extends only partially throughout the core 300B.

Figure 3C:
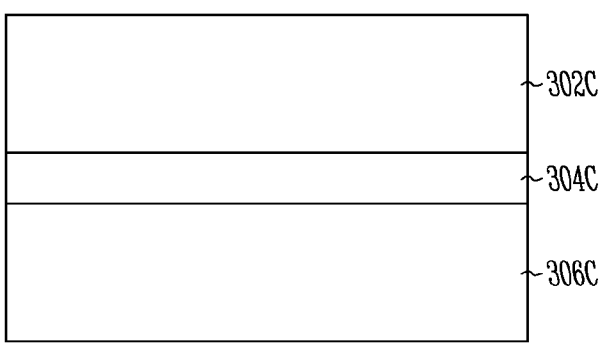

FIG. 3C illustrates a third cross-section of a core 300C. In an example, the core 300C includes a first portion 302C, a second portion 304C, and a third portion 306C. The first portion 302C and the third portion 306C can be composed of a first material, and the second portion 304C can be composed of a second material. In an example, the first material has a lower magnetic saturation level than the second material. In an example, such as shown, the second material includes a planar structure such as in between the first and third portions 302C, 306C of the first material.

In an example, the cross-section of the core 300C shown in FIG. 3C can be substantially similar throughout the core 300C such that both the first portion 302C and the second portion 304C extend all around the continuous loop (in the case of a toroid core) or from one end to the other (in the case of a solenoid). In another example, the cross-section of the core 300C need not be substantially similar through the core 300C such that the second portion 304C extends only partially throughout the core 300C.

FIG. 3D illustrates a fourth cross-section of a core 300D. In an example, the core 300D includes an outer portion 301D and a plurality of inner portions 302D, 304, 306D, 308D within the outer portion 301D. In an example, inner portions can include a first, second, third, and fourth inner portions 302D, 304D, 306D, 308D respectively. In an example, the outer portion 301D and the first and third inner portion 302D, 306D are composed of a first material having a first saturation level. In this example, the second and fourth portions 304D, 308D are composed of a second material having a higher saturation level than the first material. Accordingly, sheets of the second material can be interspersed within the first material.

In an example, the cross-section of the core 300D shown in FIG. 3D can be substantially similar throughout the core 300D such that each of the portions 301D and 302D, 304, 306D, 308D can extend all around the continuous loop (in the case of a toroid core) or from one end to the other (in the case of a solenoid). In another example, the cross-section of the core 300D need not be substantially similar through the core 300D such that the inner portions 302D, 304, 306D, 308D can extend only partially throughout the core 300D.

Although four different examples of cross-sections of a core are illustrated in FIGS. 3A-3D, in certain examples, other cross-sections can be used. In certain examples, one or more of the portions (e.g., the first portion 302A or the second portion 302B) in the cores 300A, 300B, 300C, or 300D can include laminated sheets of a ferromagnetic or ferrimagnetic material (e.g., the second material) such as with sheets of insulator between adjacent sheets of the material to reduce heating or eddy currents within the core.

Figure 4:
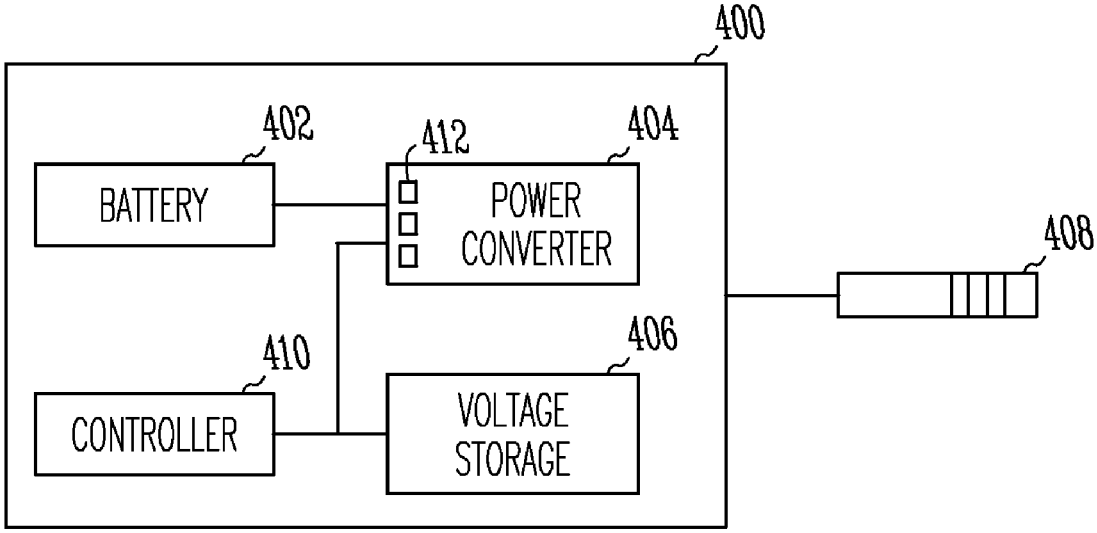
FIG. 4 illustrates generally a block diagram of an example of system, such as for an implantable medical device, that can include an inductive component such as the inductive component of FIG. 1.

FIG. 4 illustrates generally an example of an implantable medical device (IMD) 400 including an inductive component configured to provide inductance in both weak and strong magnetic fields. In an example, the implantable medical device (IMD) 400 can include a battery 402, a power converter circuit 404, a voltage storage circuit element 406, a lead 408, and a controller circuit 410.

In an example, the power converter 404 can be configure to convert energy from the battery 402 into a voltage suitable for operating the IMD circuits or for providing cardioversion or defibrillation shock therapy to a patient. In an example, the power converter 404 can include a flyback power converter. The voltage converted from the power converter 404 can be stored in the voltage storage circuit element 406. In an example, the voltage storage circuit element 406 can include one or more capacitors. The voltage can be stored in the voltage storage circuit element 406 until the controller 410 instructs the voltage storage circuit element 406 to release the voltage, such as for use by the internal circuitry or for delivery as therapy by the lead 408.

In an example, the power converter 404 can include one or a plurality of inductive components 412. The inductive components 412 can be used to generate the voltage used to charge the voltage storage circuit element 406 from the battery 402. In an example, one or more of the inductive components 412 can include a core having a first and a second portion composed of a first and a second material. The first material can have a lower magnetic saturation level than the second material. In an example, the core of one or more of the inductive components 412 can include core 102 or core 202.

In an example, the first material can be a ferrite having a magnetic saturation level of around 0.5 Tesla and the second material can be a ferromagnetic metallic alloy having a magnetic saturation level around 1.5 Tesla. Accordingly, during normal conditions, when an external magnetic field is below 0.2 Tesla, both the first portion and the second portion of the inductive components 412 can provide inductance such as to support the charging of the shock storage circuit element. When the patient is exposed to an MRI field, however, the first portion can become magnetically saturated so as to not provide inductance to support the charging of the shock storage circuit element. When the inductive component 412 is exposed to the MRI field, the second portion of the core can provide inductance such as to support the charging of the shock storage mechanism.

In an example, the quantity of inductance provided by the second material can be less than the quantity of inductance provided by the first material. Thus, when the inductive component 412 is exposed to an MRI field, the inductive component 412 can provide in the range of 5%-30% of the inductance that is provided by the inductive component 412 when not exposed to an MRI field. Since the second portion provides a smaller quantity of the inductance than the first portion, a smaller volume of the second material can be used as compared to the volume of the first portion. This can be advantageous to reduce the cost of the inductive component. In certain examples, the second material can be substantially more expensive than the first material. Accordingly, reducing the volume of the second portion can provide cost savings.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

What is claimed is:

1. An implantable medical device comprising:

a core for an inductive component comprising:

a first portion composed of a first material selected to provide inductance for the inductive component, the first material having a first magnetic saturation level; and a second portion composed of a second material selected to provide inductance for the inductive component when an external magnetic field is greater than the first magnetic saturation level, wherein the second material is configured to provide an inductance to the inductive component such that the inductive component is configured for operation of the implantable medical device within a magnetic resonance imaging device at exposure to greater than the first magnetic saturation level.

2. The implantable medical device of claim 1, wherein the first and second material are configured to provide an inductance via at least one of ferromagnetism and ferrimagnetism.

3. The implantable medical device of claim 1, wherein the first material includes a maximum inductance, and wherein the second material is configured to provide inductance that is at least 10% of the maximum inductance of the first material when the first material substantially saturates.

4. The implantable medical device of claim 1, wherein the first magnetic saturation level is less than about 0.6 Testa, and wherein the second material has a second magnetic saturation level of greater than about 1.5 Tesla.

5. The implantable medical device of claim 4, wherein the first material includes a ferrite and the second material includes at least one of: a ferromagnetic metallic alloy and a magnetic nanoparticle based material.

6. The implantable medical device of claim 1, wherein the second material has a volume that is in the range of 5%-30% relative to a volume of the first material.

7. The implantable medical device of claim 1, wherein a resistivity of the second material is greater than about 10 $\mu\Omega\cdot$cm.

8. The implantable medical device of claim 1, wherein the first material forms a first continuous magnetic loop; and wherein the second material forms a second continuous magnetic loop.

9. The implantable medical device of claim 1, wherein the second material comprises a plurality of sheets interspersed with the first material.

10. The implantable medical device of claim 1, wherein the first material comprises a plurality of sheets, wherein an insulator is positioned between the adjacent pairs of the sheets.

11. The implantable medical device of claim 1, including a flyback power converter including the inductive component.

12. The implantable medical device of claim 1, wherein the second material provides inductance for the inductive component when an external magnetic field is below the first magnetic saturation level.

13. An implantable medical device comprising:

an inductive component comprising:

a first electrically conductive wire forming a first at least one loop; and a core for the inductive component, the core comprising:

a first portion comprising a first material, wherein the first material is positioned at least partially within the first at least one loop so as to provide an inductance for the first electrically conductive wire when a current is propagated through the conductive wire, and wherein the first material has a first magnetic saturation level; and a second portion comprising a different second material, wherein the second material is positioned at least partially within the first at least one loop so as to provide an inductance for the first electrically conductive wire when a current is propagated through the conductive wire, and wherein the second material is selected to provide an inductance when an external magnetic field is greater than the first magnetic saturation level, wherein the second material is configured to provide an inductance to the inductive component such that the inductive component is configured for operation of the implantable medical device within a magnetic resonance imaging device at exposure to greater than the first magnetic saturation level.

14. The implantable medical device of claim 13, wherein the second material has a higher magnetic saturation level than the first material.

15. The implantable medical device of claim 13, wherein at least one of the first material and the second material is configured to provide an inductance via ferromagnetism or ferrimagnetism.

16. The implantable medical device of claim 13, wherein the first material has a first magnetic saturation level of less than about 0.6 Tesla, and wherein the second material has a second magnetic saturation level of greater than about 1,5 Tesla.

17. The implantable medical device of claim 13, wherein the first material is a ferrite and wherein the second material includes at least one of: a ferromagnetic metallic alloy and a magnetic nanoparticle based material.

18. The implantable medical device of claim 13, wherein the implantable medical device includes a flyback power converter, and the flyback power converter includes the inductive component.

19. The implantable medical device of claim 13, wherein the second material has a higher magnetic saturation level than the first material.

20. An implantable medical device comprising:

a flyback power converter comprising:

an inductive component comprising:

a first electrically conductive wire forming a first at least one loop; and a core for the inductive component, the core comprising:

a first portion comprising a first material, wherein the first material is positioned at least partially within the first at least one loop so as to provide an inductance for the first electrically conductive wire when a current is propagated through the conductive wire, and wherein the first material has a first magnetic saturation level; and a second portion comprising a different second material, wherein the second material is positioned at least partially within the first at least one loop so as to provide an inductance for the first electrically conductive wire when a current is propagated through the conductive wire, wherein the second material is selected to provide an inductance when an external magnetic field is greater than the first magnetic saturation level; and wherein the second material comprises multiple sheets of the second material that are interspersed with the first material, wherein the second material is configured to provide an inductance to the inductive component such that the inductive component is configured for operation of the implantable medical device within a magnetic resonance imaging device at exposure to greater than the first magnetic saturation level.

* * * * *